United States Patent [19]

Raih

[11] 4,254,160

[45] Mar. 3, 1981

[54] METHOD FOR SLURRY COATING A FACEPLATE PANEL HAVING A PERIPHERAL SIDEWALL

[75] Inventor: Frederick C. Raih, Marion, Ind.

[73] Assignee: RCA Corporation, New York, N.Y.

[21] Appl. No.: 103,920

[22] Filed: Dec. 17, 1979

[51] Int. Cl.[3] ..... H01J 29/18; B08B 3/12; B05D 1/02; B05D 1/30

[52] U.S. Cl. ..... 427/57; 427/68; 427/72; 427/73

[58] Field of Search ..... 427/57, 68, 72, 73

[56] References Cited

U.S. PATENT DOCUMENTS

| | | | |
|---|---|---|---|
| 2,902,973 | 9/1959 | Weingarten et al. | 118/53 X |
| 3,364,054 | 1/1968 | Weingarten | 427/72 |
| 3,653,941 | 4/1972 | Bell et al. | 427/68 X |
| 3,672,932 | 6/1972 | D'Augustine | 427/72 |
| 3,759,735 | 9/1973 | Pekosh | 427/64 |
| 4,035,524 | 7/1977 | Fritsch | 427/68 |
| 4,078,095 | 3/1978 | Ratay | 427/68 X |

*Primary Examiner*—James R. Hoffman

*Attorney, Agent, or Firm*—E. M. Whitacre; G. H. Bruestle; L. Greenspan

[57] ABSTRACT

To coat the inner surface of the viewing window of a faceplate panel for a cathode-ray tube, of the type having a peripheral sidewall or flange around the window, dispense onto the surface a quantity of slurry in excess of what is required for the desired coating, spread the dispersed slurry over the surface, wet the uncoated inner surface of the sidewall with an aqueous medium, pass the excess portion of the slurry over the wet sidewall surface for removal from the panel, and then remove particulate material from the inner sidewall surface.

8 Claims, 6 Drawing Figures

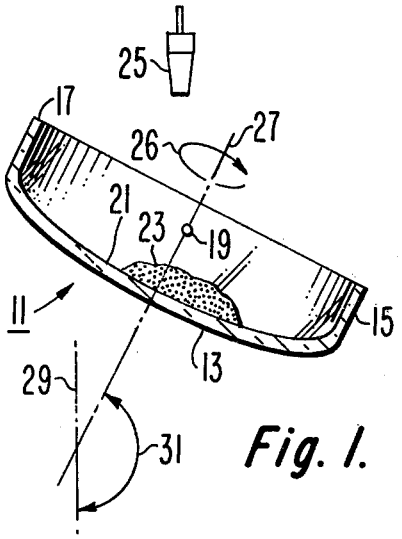
Fig. 1.
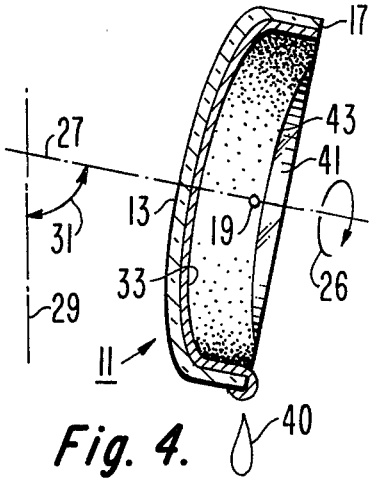
Fig. 4.
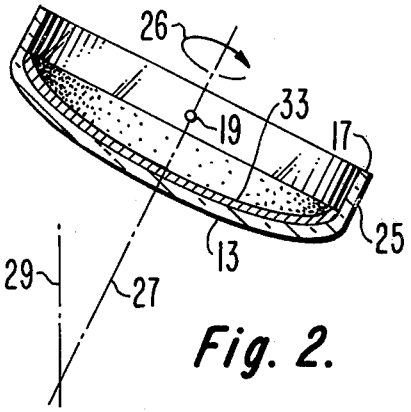
Fig. 2.
Fig. 5.
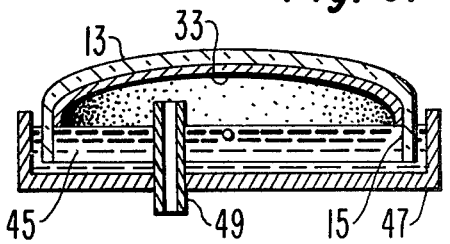
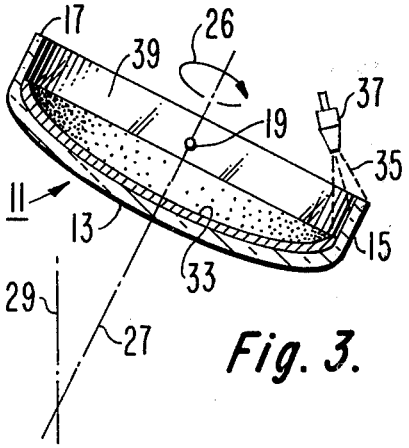
Fig. 3.
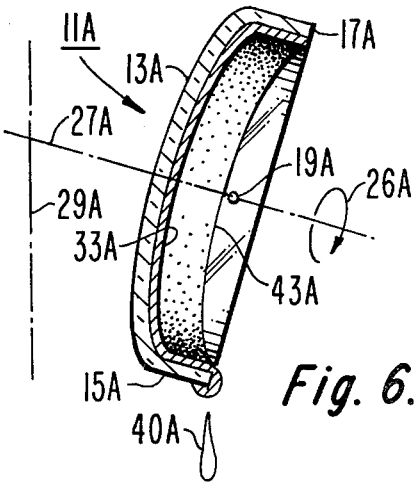
Fig. 6.

METHOD FOR SLURRY COATING A FACEPLATE PANEL HAVING A PERIPHERAL SIDEWALL

BACKGROUND OF THE INVENTION

This invention relates to a novel method for slurry coating the surface of the viewing window of a faceplate panel having a peripheral sidewall. The novel method may be applied particularly to coating a layer of phosphor particles upon the inner surface of the viewing window of a faceplate panel, which panel is subsequently used to make a cathode-ray tube; for example, a color-television picture tube.

In one method for making a luminescent viewing screen for a color-television picture tube, a quantity of slurry in excess of what is required to make the screen is dispensed on and spread over the inner surface of the viewing window of a faceplate panel. The panel comprises a central glass viewing window and an integral peripheral sidewall or flange around the window, the distal end of which is a sealing land. The slurry comprises a mixture of phosphor particles, a binder such as polyvinyl alcohol, a photosensitizer for the binder such as sodium or ammonium dichromate, and a liquid vehicle such as water. The slurry is spread by rotating and tilting the panel so that the slurry spreads evenly over the window surface. At the time of dispensing, the temperature of the slurry is in the range of 18° to 30° C., while the temperature of the panel is in the range of 25° to 50° C. The excess slurry is then removed, as by rapidly spinning the panel to move the excess slurry by centrifugal force up the sidewall and over the sealing land and to sling the excess slurry from the panel.

By another method for removing the excess slurry, the panel is slowly rotated and then tilted to a high angle to move the slurry across the sidewall to the sealing land and to dump the excess slurry from the panel. By either method for removing the excess slurry, a variable area of the sidewall is coated with the slurry. The boundary of this area is not predictable, but usually falls close to the viewing window at some places and crosses the sealing land at other places. Then, the sealing land and the adjacent sidewall are cleaned, preferably ultrasonically, to remove residual particulate matter.

Because some drying occurs during the time period between the step of removing the excess slurry and the step of cleaning the sidewall, a bead comprising particulate matter of the slurry forms at the above-mentioned boundary, which bead is more difficult to remove than the adjacent coating. Also, a portion of the bead frequently is located too close to the window to prevent it from being removed economically. By the novel method, the bead is formed close to or at the sealing land where it can be removed economically by ultrasonic or mechanical means. The foregoing steps for coating the panel are usually conducted on automatic or semiautomatic machines in which a series of panels pass single file through a sequence of stations in which the steps are carried out. The novel method may be carried out on such machines.

SUMMARY OF THE INVENTION

In the novel method, as in the prior method, a quantity of slurry in excess of what is required to make the desired coating is dispensed onto the window surface, spread over the surface and then the excess slurry is passed over the sidewall and removed from the panel.

Unlike the prior method, the uncoated inner surface of the sidewall is wetted with an aqueous medium after spreading the slurry and before removing the excess slurry. The wet surface causes the bead to form close to or at the sealing land where it can be removed economically. The wetting step can be performed conveniently and economically with automatic or semiautomatic machinery using water, preferably deionized water, or water containing a wetting agent such as polyvinyl alcohol.

BRIEF DESCRIPTION OF THE DRAWING

FIGS. 1 through 5 are a series of sectional elevational views of a faceplate panel illustrating the steps, respectively, in a preferred embodiment of the novel method, of dispensing a quantity of slurry into a faceplate panel (FIG. 1), spreading the slurry over the window of the panel (FIG. 2), wetting the uncoated sidewall of the panel (FIG. 3), removing the excess slurry from the panel (FIG. 4) and showing a typical location of the bead of slurry material, and then cleaning the coated sidewall ultrasonically (FIG. 5).

FIG. 6 is a sectional elevational view of a faceplate panel in a prior method during the step of removing the excess slurry and showing a typical location of the bead of slurry material.

DESCRIPTION OF THE PREFERRED EMBODIMENT

The preferred embodiment is described with respect to coating the inner surface of the viewing window of a series of faceplate panels for cathode-ray tubes, particularly for assembly into color-television picture tubes. As shown in FIGS. 1 to 5, a faceplate panel 11 comprises a glass viewing window 13 and an integral sidewall or flange 15 around the window 13. The extended or distal end of the sidewall 15 comprises a sealing land 17. At least three metal studs 19 are sealed into the inner side of the sidewall between the window 13 and the sealing land 17.

In this preferred method, each of three phosphors (red-emitting, green-emitting, and blue-emitting) is incorporated into a separate slurry, is separately coated on the inner surface 21 of each window, and then is processed to produce a phosphor dot pattern. The pattern may be of other materials than of phosphors, and may be in other shapes than dots; for example, there may be arrays of stripes or other shapes. Apparatus and methods for carrying out the coating step are disclosed in the prior art; for example, U.S. Pat. Nos. 2,902,973 to M. R. Weingarten; 3,364,054 to M. R. Weingarten; 3,672,932 to F. T. D'Augustine; and 3,653,941 to B. B. Bell et al. The method for coating the panel used in the preferred embodiment herein is described in detail in U.S. Pat. No. 4,078,095 to J. M. Ratay.

In the preferred embodiment of the novel method, a faceplate panel 11 is held in a work holder (not shown), which is rotated and tilted to carry out the method steps. The work holder may move from station to station where the various method steps in the fabrication process are carried out. As shown in FIG. 1, a metered quantity of slurry 23 is dispensed from a dispensing nozzle 23 onto the inner surface 21 of the slowly rotating and tilted panel 11. The panel 11 rotates, as shown by the arrow 26, about a rotation axis 27 that is normal to the plane of the sealing land and passes through the center of the window 13. The rotation axis 27 is tilted from a vertical axis 29 by an angle 31 from the zero degree axis position in which the sealing land faces down.

As shown in FIG. 2, the work holder is made to rotate and tilt according to a prescribed program for the purpose of producing a coating or layer 33 of phosphor particles on the surface of the viewing window of the panel. The rate of rotation and the angle of tilt of the rotation axis are adjusted to cause a puddle of phosphor slurry to spiral outwardly around the inner surface of the viewing window until the entire surface has been covered.

Then, as shown in FIG. 3, with the panel 13 continuing to rotate about the axis 29 at a tilted angle, a spray 35 from a nozzle 37 deposits a small amount of deionized water onto the uncoated portions 39 of the sidewall 15. While there is some overspray, essentially all of the spray water is deposited on the uncoated surface in an amount sufficient to wet the surface but insufficient to produce any substantial runoff onto the layer 33.

Instead of deionized water, any aqueous medium that does not contain substances that are deleterious to the slurry or the coating method may be used. Deionized water, distilled water or water containing small amounts of a wetting agent, such as polyvinyl alcohol, may be used.

Next, the excess slurry is removed from the panel. As shown in FIG. 4 the panel 11 is rotated slowly about the rotation axis 27 which is at about 80° from the vertical axis 29. The excess slurry 40 passes over a portion of the sidewall 15 and is dumped over the sealing land 17. In so doing, a portion of the sidewall 17 is coated and another portion 41 is left uncoated. A bead of slurry material forms along the coated side of the boundary 43. The boundary 43 is located at the sealing land 17 and, as shown in FIG. 4, may extend between the metal stud 19 and the sealing land.

Next, the rotation is stopped and the rotation axis is reduced to 0° (sealing land down) and the sidewall 15 is immersed in an aqueous medium 45 from the sealing land 17 up to a position between the stud 19 and the coating 33, but not including the coating 33. The aqueous medium 45 is contained in a trough 47 having a port 49 for relieving air pressure within the panel 11. In the position shown in FIG. 5, slurry material is removed from the sidewall 15 ultrasonically by any of the methods known in the art. One method for ultrasonically cleaning a sidewall is described in U.S. Pat. No. 3,759,735 to R. J. Pekosh. The sidewall 15 may be cleaned mechanically instead or in addition.

Because the bead formed at the boundary 43 is at or close to the sealing land 17, it can be removed conveniently and economically ultrasonically. FIG. 6 shows a panel 11A during the removal of the excess slurry 40A by the prior method. A bead forms on the coated side of the boundary 43A, a portion of which is between the stud 19A and the coating 33A. This position is very difficult to clean without disrupting the coating 33A. The bead is thicker than the coating 33A. After it hardens by the drying action which occurs immediately after removing the excess slurry, the bead is more difficult to remove than the coating on the sidewall 15A. FIG. 6 is to be compared with FIG. 4 where the boundary 43 is located where it can be reached by mechanical or ultrasonic techniques.

What is claimed is:

1. In a method for coating a layer of particulate material on the inner surface of a faceplate panel for a cathode-ray tube, said panel comprising a viewing window and a peripheral sidewall integrally attached around said window and having a sealing land at the distal edge thereof, (a) dispensing into said panel a quantity of slurry comprising said particulate material mixed with a liquid vehicle, said quantity including a portion in excess of the amount required to produce said layer, (b) spreading said quantity of slurry over the inner surface of said window, (c) then wetting the uncoated inner surface of said sidewall with an aqueous medium, (d) then passing said excess portion of slurry over said wetted surface for the removal thereof from said panel, (e) and then removing any residual particulate material from the inner surface of said sidewall adjacent said sealing land.

2. The method defined in claim 1 wherein said aqueous medium is deionized water.

3. The method defined in claim 1 wherein said aqueous medium is a dilute solution of polyvinyl alcohol.

4. The method defined in claim 1 wherein said material is removed ultrasonically in an aqueous medium.

5. In a method for making a luminescent screen on the inner surface of a faceplate panel for a cathode-ray tube, said panel comprising a viewing window and a peripheral sidewall integrally attached around said window and having a sealing land at the distal edge thereof, (a) dispensing into said panel a quantity of slurry comprising phosphor particles, a binder therefor, and water, said quantity including a portion in excess of the amount required to produce said screen, (b) rotating and tilting said panel to spread said amount of slurry over the inner surface of said window, (c) after step (b), wetting the uncoated inner surface of said sidewall adjacent said sealing land with an aqueous medium, there being substantially no excess aqueous medium present beyond that which is required for said wetting, (d) then passing said excess portion of slurry over said wetted surface for the removal thereof from said panel, (e) and then removing any residual material from the inner surface of said sidewall adjacent said sealing land.

6. The method defined in claim 5 wherein, at step (c), an aqueous solution of polyvinyl alcohol is sprayed upon the uncoated inner surface of said sidewall.

7. The method defined in claim 5 wherein, at step (c), deionized water is sprayed upon the uncoated inner surface of said sidewall.

8. The method defined in claim 5 wherein, at step (d), the panel is rotated slowly about a rotation axis which is at about 80° from a vertical axis until said excess slurry passes over said sidewall and is dumped over said sealing land.

* * * * *